United States Patent [19]

Kane

[11] Patent Number: 4,720,955

[45] Date of Patent: Jan. 26, 1988

[54] TILE

[75] Inventor: Patrick J. Kane, Vancouver, Canada

[73] Assignee: Creative Metal Designs Ltd., Vancouver, Canada

[21] Appl. No.: 926,954

[22] Filed: Nov. 4, 1986

Related U.S. Application Data

[63] Continuation-in-part of Ser. No. 709,208, Mar. 7, 1985, Pat. No. 4,691,492.

[51] Int. Cl.[4] ..... E04D 1/18

[52] U.S. Cl. ..... 52/519; 52/521; 52/533

[58] Field of Search ..... 52/519, 520, 530, 537, 52/536, 528, 521, 534, 533, 542

[56] References Cited

U.S. PATENT DOCUMENTS

| | | | |
|---|---|---|---|
| 263,835 | 9/1882 | Atterbury | 52/537 |
| 292,585 | 1/1884 | Repp | 52/519 |
| 294,256 | 2/1884 | Montross | 52/519 |
| 297,529 | 4/1884 | Mott | 52/520 |
| 496,478 | 5/1893 | Grafton | 52/521 |
| 2,128,836 | 8/1938 | McVoy | 52/537 |

*Primary Examiner*—John E. Murtagh

*Attorney, Agent, or Firm*—Carver & Co.

[57] ABSTRACT

A tile formed from a relatively thin sheet is adapted to cooperate with similar tiles to form a tiled surface. When the tile is installed, the central axis thereof coincides with a line defining free water flow down the tile between upper and lower tile portions. The tile has first and second raised ribs extending symmetrically as mirror images of each other on each side of central axis. Each rib has upper and lower rib portions which are interconnected so as to extend continuously between the upper and lower tile portions to increase stiffness of the tile. The upper rib portions are generally complementary to the lower rib portions so that the lower rib portions of an upper tile can fit over upper rib portions of a lower tile. Thus rib axes of upper and lower rib portions are also mirror images of each other about a lateral axis disposed perpendicularly to the longitudinal axis. The tiles are effectively secured in four places to increase resistance to movement. When the tiles are fitted, the ribs of the tiles are interlocked and this increases accuracy of installation of the tiles, as well as reducing a tendency of water seepage past edges of the tiles. The tiles exhibit a high degree of fitting tolerance, even when fitted on an uneven roof, thus permitting use of relatively unskilled labor.

20 Claims, 9 Drawing Figures

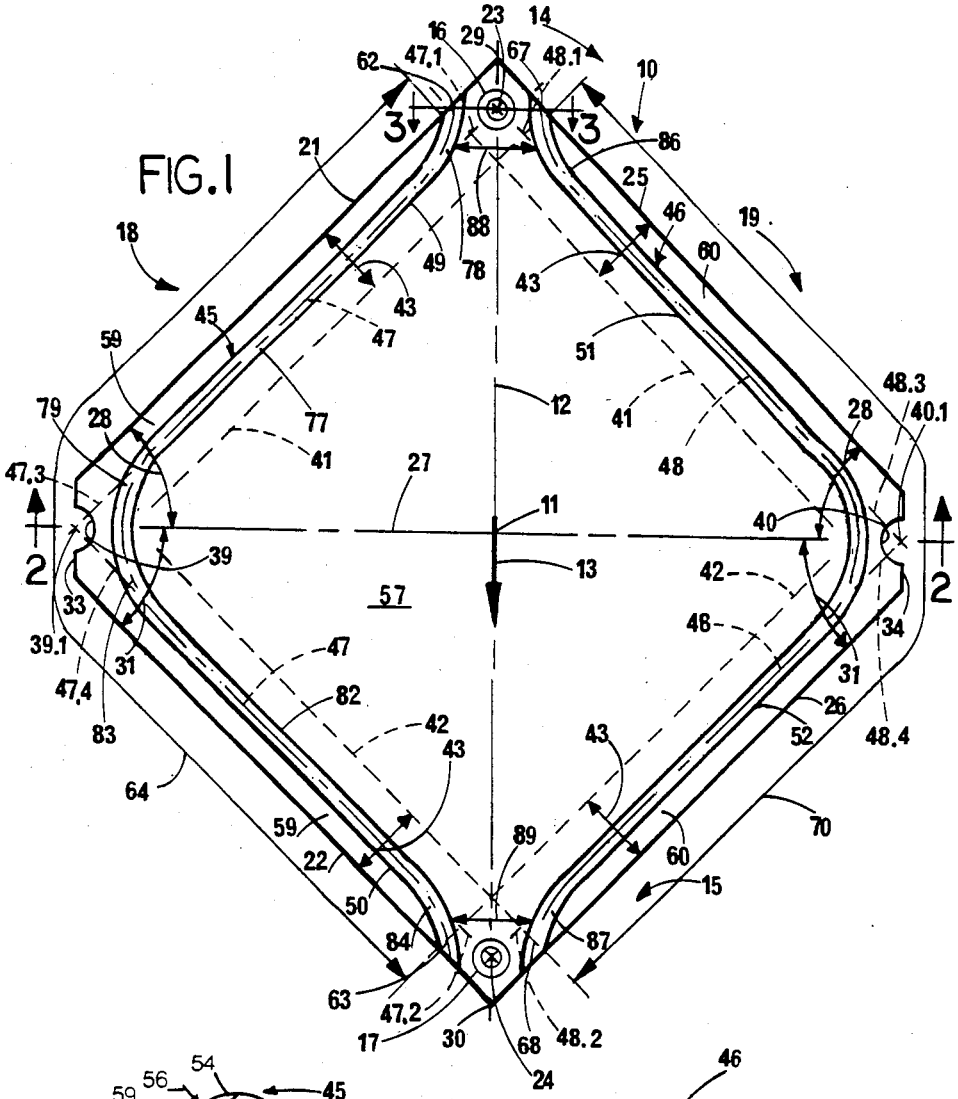
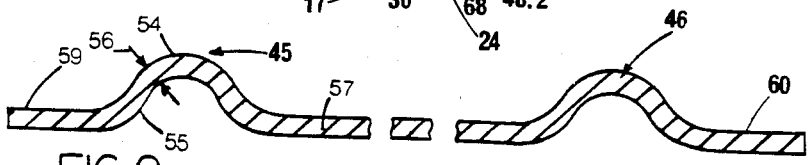
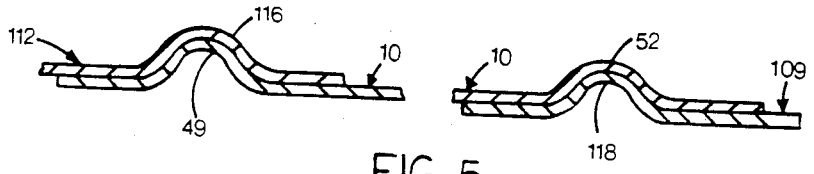
FIG.5

TILE

CROSS REFERENCES TO RELATED APPLICATION

This is a continuation-in-part of my copending application Ser. No. 06/709,208 filed Mar. 7, 1985, now U.S. Pat. No. 4,691,492, issued Sept. 8, 1987.

BACKGROUND OF THE INVENTION

The invention relates to a tile particularly for installation on a sloping roof, but the tile could have applications elsewhere, for example on a vertical wall.

Interlocking roof tiles or shingles have been known for many years, and are commonly found as two main types, namely relatively thick clay tiles, or sheet tiles, which are made from sheet metal or other similar thin material. The clay tiles are heavy, mechanically relatively weak and are limited in mechanical complexity due to manufacturing difficulties and material limitations. Metallic sheet tiles also have problems, for example a tendency to bend and be permanently deformed after a person has walked over the roof, which is aggravated by insufficient backing support for the tile. Also, if a relatively thin material is used, the tile might lack adequate stiffness to resist bending under strong wind forces blowing up the roof and bending the tile upwardly, thus permitting water to penetrate under the tile. While attempts have been made to stiffen relatively thin tiles using several raised ribs extending between edges of the tile, commonly the ribs increase difficulty of installation of the tile because some designs of tile do not permit much variation or tolerance to the "fit" between overlapping portions of adjacent tiles, particularly when installed on uneven roofs. Commonly, with prior art ribbed metallic tiles, fitting errors during installation of a series of tiles can accumulate to such an extent that unsightly gaps can exist between overlapping portions of adjacent tiles, which can permit entry of water into the roof. In general the more complex the ribbed structure of the overlapping portions, the greater the difficulty and cost of manufacture and installation.

Typical metallic tiles are shown in U.S. Pat. Nos. 279,487 issued to Jones; 294,256 issued to Montross et al; 361,031 issued to Thorn; 397,298 issued to Lee; 403,837 issued to Gusten; 562,798 issued to Brocker and 2,202,830 issued to Bussey. These patents disclose metallic roofing tiles with ribs to cooperate with adjacent tiles, and partially to stiffen the tile. However, some of the immediate edge fitting structure includes the actual ribs themselves, and these are quite complex and would likely present difficulties when installing the tiles. Ribs provided immediately adjacent edges of the tiles without flat side margins extending to the edges can present difficulties during the manufacture and installation and can present difficulties during inclement weather.

In general, to produce a tile of a given size, tiles with several ribs or corrugations require considerably more sheet stock or raw sheet material than a flat, unribbed tile or a tile with fewer ribs. Also, some tiles require a relatively wide overlap with adjacent tiles to obtain a water tight joint, and this affects the number of tiles required to cover a specific roof area with tiles of a given size. Clearly the greater the overlap between tiles, the more tiles are required to cover a given roof area. Some prior art tiles have many corrugations and also require a large overlap and thus the effectiveness of such tiles for covering area is low.

Some of the prior art tiles have interfitting edge portions which cooperate closely with complementary edge portions of adjacent tiles such that relatively small gaps of short lengths exist between the tiles. There gaps can be of such a size as to cause water to be drawn by capillarity effects through the gaps, around the ribs and into the roof, which can resemble leaks from a leaking roof. The ribs and/or edges of most prior art tiles are asymmetrical and thus cannot be trimmed and reversed easily for fitting in confined spaces, or to reduce wastage of tile portions. Also, some tiles do not lend themselves to easy vertical stacking and thus can be awkward to transport or store.

SUMMARY OF THE INVENTION

The present invention reduces the difficulties and disadvantages of the prior art by providing a tile which is relatively simple to manufacture by pressing a thin sheet of metal. The present tile can be installed using relatively unskilled labour due to a relatively wide fitting tolerance resulting from the simplicity of the ribbed structure which cooperates with adjacent tiles. Portions of tiles which cooperate with adjacent tiles can be made to have a wide tolerance to variations in spacing between adjacent tiles, and can accommodate, to some extent, unevenness or irregularities in the roof. Furthermore, the tiles of the invention have raised rib portions which provide the stiffness which extends the full length of the tile i.e. between upper and lower tile portions, which can resist the weight of a person walking on the roof without permanent deformation. The tile can be secured directly to the roof using two fasteners, but cooperation with adjacent tiles on opposite side of the tile effectively secures the tile at four places so that strong wind blowing upwards or along the roof will have a negligible tendency to lift the tile, when compared with some prior art tiles. This reduces the number of fasteners that would otherwise be needed for equivalent securing. Also, spacing between cooperating portions of adjacent tiles is such as to reduce any tendency for capillarity effects to draw water horizontally, or slightly upwardly between adjacent tiles.

In contrast with some prior art tiles, the present tile has only two raised ribs which do not require much additional sheet stock for forming when compared with a flat unribbed tile. Also, the present tile requires a relatively small overlap with adjacent tiles, and thus relatively fewer tiles are required to cover a given area. The two factors above contribute to the overall efficiency of this present tile in covering a given roof area. Furthermore the ribs or edges are disposed symmetrically of the tile which facilitates trimming the tile to fit in confined spaces by reversing the tile if necessary. This symmetry also facilitates using portions of trimmed tiles along the ridge of a gable roof, thus reducing waste.

A tile according to the invention is adapted to cooperate with similar tiles to form a tiled surface. The tile is a relatively thin sheet having a periphery having first and second side edges intersecting at upper and lower corners. The edges are disposed symmetrically about a central longitudinal axis extending between the corners and adapted so that, when the tile is installed, the central axis coincides essentially with a line defining free water flow down the tile. The tile has a lateral axis disposed normally to the central axis to divide the tile into upper and lower tile portions. The tile has first and second raised ribs having respective rib axes extending symmetrically as mirror images of each other on each side of the central axis. Each rib has upper and lower rib portions on opposite sides of the lateral axis which are interconnected so as to extend continuously between the upper and the lower tile portions to increase stiffness of the tile. The rib axes are mirror images of each other about the lateral axis, and the upper rib portions are generally complementary to the lower rib portions so that the lower rib portions of an upper tile can fit over upper rib portions of a lower tile. The ribs intersect the respective side edges positions spaced laterally from, but generally adjacent to the upper and lower corners to provide first and second intermediate edge portions extending between the intersections of the first and second ribs with the first and second side edges respectively. The tile also has a generally flat first side margin extending between the first intermediate edge portion and the first rib, and a similar generally flat second side margin extending between the second intermediate edge portion and the second rib. Thus, the tile has essentially flat side margins extending along most of the first and second side edges to provide an adequate overlap with adjacent tiles. The tile has upper and lower clearance means provided adjacent the upper and lower corners respectively, the clearance means having respective raised portions with openings passing therethrough to receive respective fasteners for securing the tile to the backing means. The tile also has first and second clearance means adjacent the first and second side edges respectively to cooperate with clearance means of adjacent tiles to locate the side edges of the tile.

A detailed disclosure following, related to drawings, described a preferred embodiment of the invention, which is capable of expression in structure other than that described and illustrated.

DESCRIPTION OF THE DRAWINGS

FIG. 1 is a simplified top plan of a tile according to the invention,

FIG. 2 is a simplified fragmented section as seen on line 2—2 of FIG. 1,

FIG. 5 is a simplified fragmented section on line 5—5 of FIG. 4 showing cooperation between raised ribs of adjacent tiles.

Figure 3:
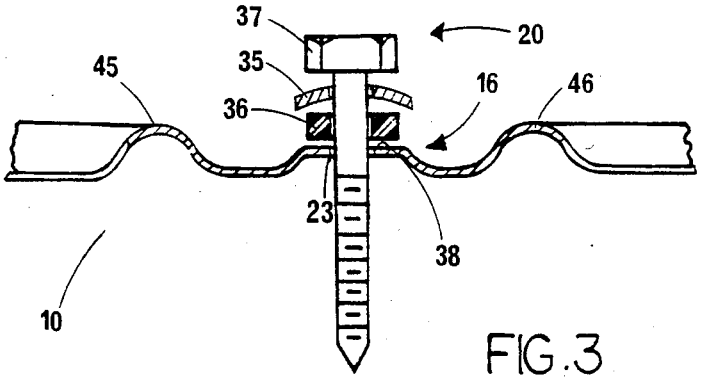
FIG. 3 is a simplified fragmented section on line 3—3 of FIG. 1, showing a fastening means prior to securing.

The tiles as drawn are "idealised" and are shown with straight edges. In an actual pressed sheet steel tile, the geometry can vary and tile edges are slightly curved due to pressing.

DETAILED DISCLOSURE

FIGS. 1–3

Referring mostly to FIG. 1, a tile 10 is formed from a relatively thin sheet or blank of metallic material and has a periphery disposed symmetrically about a central longitudinal axis 12. When the tile is installed, the central longitudinal axis 12 coincides essentially with a line defining free water flow down the tile, shown as an arrow 13, between upper and lower tile portions 14 and 15. The tile has first and second side edges 18 and 19 disposed symmetrically about the axis 12. The side edge 18 has generally straight upper and lower edge portions 21 and 22 respectively, and the side edge 19 has upper and lower edge portions 25 and 26. The edge portions 21 and 25 are inclined at equal angles 28 to a transverse line or lateral axis 27 which is disposed perpendicularly to the central axis 12 of the tile and divides the tile into the upper and lower portions 14 and 15. The axes 12 and 27 intersect at a centre 11 of the tile, and the edge portions 22 and 26 are similarly inclined at equal angles 31 to the line 27. Preferably, the angles 28 and 31 are equal to 45 degrees, so that the portions 21 and 22, and the portions 25 and 26, are inclined to each other at 90 degrees, ignoring mitred edge portions as will be described. Upper and lower portions of the side edges 18 and 19 intersect each other at upper and lower corners 29 and 30 respectively of the tile as shown, the axis 12 extending between the corners. Angles between adjacent sides 21 and 25, and 22 and 26 are also 90 degrees, so as to define a generally square tile, which, when installed with the central axis 12 vertical resembles a generally diamond-shaped tile.

Upper and lower raised bosses 16 and 17 of circular planform and having respective openings 23 and 24 are provided adjacent the upper and lower corners respectively and symmetrically of the axis 12. The bosses 16 and 17 are similar to each other and resemble shallow truncated cones having generally flat circular tops and bases having maximum diameters adjacent where they merge or blend into the main plane of the tile. The openings provide clearance means to receive respective fasteners i.e., screws 20, so as to secure the tile at upper and lower corners respectively. As seen in FIG. 3, a rigid dished washer 35 and a resilient sealing washer 36 are fitted under a head 37 of the screw and are received on a flat central portion 38 of the raised boss. The screws secure the tile to a base or backing means of a roof, such as battens or plywood sheathing, not shown in FIG. 3. The screws 20 passing through the clearance openings 23 and 24 serve as attachment means adjacent the upper and lower corners and adjacent the central axis 12 to provide two positive attachments to the roof approximately centrally of the tile. Both screws are exposed to the elements and thus the washer 35 is larger than the washer 36 and is curved inwardly to shield the resilient material from sunshine, thus reducing deterioration. Cooperation with adjacent tiles is described in greater detail with reference to FIGS. 4–8.

As can be seen, a first mitred edge portion 33 interconnects the upper and lower edge portions 21 and 22, and a second mitred edge portion 34 interconnects the upper and lower edge portions 25 and 26. The mitred edge portions 33 and 34 are disposed symmetrically relative to the longitudinal and lateral axes 13 and 27 and provide clearance for adjacent tiles, as will be described with reference to FIGS. 6–8. The mitred edge portion 33 includes a first edge recess 39 and the edge portion 34 includes a second edge recess 40. The edge recesses are generally semi-circular cutouts positioned symmetrically of the transverse axis 27 and the mitred edge portions so as to be essentially equally spaced from upper and lower corners of the tile. The openings 23 and 24 are equally spaced perpendicular from the axis 27 and from the edge recesses 39 and 40. The edge recesses have diameters generally slightly larger than maximum diameter of the respective bosses to permit each recess to enclose approximately half of the boss, see FIG. 8. Thus the semi-circular edge recesses are generally complementary to the bosses, and serve as first and second clearance means to cooperate with adjacent tiles as will be described. It can be seen that centres of the openings 23 and 24, and theoretical centres 39.1 and 40.1 of the recesses 39 and 40 are spaced equally from the centre 11 of the tile.

Broken lines 41 designate approximate positions of lower edge portions of two adjacent tiles (not shown) fitted over and to the left and right of the tile 10. Similarly, broken lines 42 represent approximate positions of upper edge portions of two other adjacent tiles, (not shown), fitted under and to the left and right of the tile 10. This produces generally equal overlaps 43 between adjacent tiles which are important to the invention, as will be described with reference to FIG. 4.

The tile 10 also has first and second raised ribs 45 and 46 which extend symmetrically as mirror images of each other on each side of the longitudinal axis 12. The first rib 45 has a first rib axis 47 (broken line) and upper and lower rib portions 49 and 50. Similarly, the second rib 46 has a second rib axis 48 (broken line) and upper and lower rib portions 51 and 52. The rib axes are central axes of the respective ribs and thus also extend as mirror images of each other on each side of the longitudinal axis 12. The upper and lower rib portions of each rib are interconnected so as to extend continuously and smoothly between the upper and lower tile portions 14 and 15 to increase stiffness of the tile relative to a flat plate. As seen in FIG. 2, the rib 45 has a convex upper rib surface 54 and a concave lower rib surface 55, the rib surfaces being spaced apart by thickness 56 of the rib which approximates to thickness of a centre portion 57 of the tile. Thus the tile has an essential equal thickness throughout and can be made by simply pressing a thin gauge steel of about 0.5 mm thickness (about 27 gauge), suitably treated for corrosion resistance and preferably coated with a fine mineral granules. The granules appear to increase fitting tolerance and tend to reduce capillary action between close fitting portions of tiles. The rib 46 is similarly shaped, so that both ribs have upper convex surfaces on the same side as the tile. The upper and lower rib portions have essentially equal and constant cross sections along complete lengths thereof.

The first and second ribs 45 and 46 are spaced inwardly from the adjacent first and second side edges 18 and 19 to define generally flat first and second side margins 59 and 60 respectively of the tile. The rib 45 intersects the side edge 18 at upper and lower ends 62 and 63 generally adjacent to the upper and lower corners 29 and 30 to provide a first intermediate edge portion 64 extending between intersections of the rib 45 with the first side edge. Similarly the rib 46 intersects the side edge 18 at upper and lower ends 67 and 68 to provide a second intermediate edge portion 70 extending between intersections of the rib 46 with the second side edge 19. The first side margin 59 extends between the first intermediate edge portion 64 of the tile and the first rib 45. Similarly the second side margin 60 extends between the second intermediate edge portion 70 of the tile and the second rib 46. The central portion 57 is generally flat and generally coplanar with the first and second side margins 59 and 60, as best seen in FIG. 2.

The upper rib portions are generally complementary to the lower rib portions so that the lower rib portions of an upper tile can fit over upper rib portions of a lower tile. Thus it can be seen that the ribs of the upper and lower rib portions are also mirror images of each other about the lateral axis 27. Thus the ribs are essentially symmetrical about both the central and lateral axes 12 and 27 respectively. This provides two-axis symmetry which permits the tile to be inverted because the upper and lower tile portions are essentially identical. Thus cut portions or remnants of tiles that are produced when covering a roof can be more easily used, thus reducing waste. For example, a roof with dormer windows or several changes of roof line requires many tiles to be cut to size to fit awkward places, and it is more likely that the resulting tile remnants would be usable when the raised ribs have a constant cross-section along their length and the tile has true two-axis symmetry. To attain a relatively close fit between portions of upper and lower tiles, it is essential that the rib portions do not interfere prematurely with each other, so that coplanar flat portions of the tiles on either side of the rib portions can contact each other, as will be described with reference to FIG. 4. While it is not necessary that the engaging upper and lower surfaces of the rib portions and adjacent tile portions are exactly complementary to each other, the lower rib portion should be no greater in height or width than the maximum that can fit closely underneath the upper rib portion. To avoid prior art problems relating to the capillarity effect between closely fitting tiles, that is the ability of water to be drawn upwardly through a narrow gap between adjacent tiles, preferably there should be some reasonable clearance between edges of two tiles. This clearance can be of the order of 0.5 millimeters, or slightly greater and this should prevent excessive problems due to capillarity, and will also permit greater tolerance in manufacturing and fitting of tiles.

It can be seen that the upper rib portion 49 has a generally shallow S-shape with a generally straight mid portion 77 disposed between upwardly and downwardly curved upper and lower terminal portions 78 and 79. The mid portion 77 is generally parallel to the adjacent upper side edge portion 21. Similarly, the lower rib portion 50 has a generally shallow S-shape with a generally straight mid portion 82 disposed between upwardly and downwardly curved upper and lower terminal portions 83 and 84. The mid portion 82 is generally parallel to the adjacent lower side edge portion 22. Thus the terminal portions 79 and 83 on either side of the axis 27 form a generally arcuate central rib portion which smoothly and continuously interconnects the upper and lower rib portions.

The raised rib 46 is similar and has upper and lower terminal portions 86 and 87 which intersect the edges 25 and 26 at 67 and 68 generally adjacent the corners 29 and 30. The upper rib portion 51 is thus connected smoothly to the lower rib portion 52 by a similar arcuate central rib portion to provide a continuous transition between the adjacent rib portions. Thus the tile has two continuous stiffening ribs extending smoothly between upper and lower tile portions.

The rib axes 47 and 48 of the straight mid portions, eg.77, of the upper rib portions 49 and 51 have upwardly extending axial projections 47.1 and 48.1 which intersect the axis 12 at the upper opening 23. Similarly, the rib axes 47 and 48 of the straight mid portions, eg. 82, of the lower rib portions 50 and 52 have downwardly extending axial projections 47.2 and 48.2 which intersect the axis 12 at the lower opening 24. Also downwardly extending axial projections 47.3 and 48.3 of the straight mid portions, eg. 77, of the upper rib portions 49 and 51 intersect upwardly extending axial projections 47.4 and 48.4 of the straight mid portions, eg. 82, of the lower rib portions 50 and 52 at the axis 27, which coincide with the respective theoretical centres 39.1 and 40.1 of the recesses 39 and 40. Because the straight portions of the rib portions are parallel to adjacent side edges of the tile, and equally spaced therefrom, the straight portions of the axes 47 and 48, and axial projections thereof 47.1 through 47.4 and 48.1 through 48.4 form a generally square grid with clearance means at intersections of the axial projections which form corners of the square.

As can be seen in FIG. 1, the upper terminal portions 78 and 86 of the upper rib portions 49 and 51, and the lower terminal portions 84 and 87 of the lower rib portions 50 and 52 are spaced apart by spacings 88 and 89 respectively to provide clearance therebetween to permit water to pass easily down the tile. The upper raised boss 16 is provided between the upper terminal portions 78 and 86 of the upper rib portions, and the lower raised boss 17 is provided between the lower terminal portions 84 and 87 of the lower rib portions and cause only minor obstructions to water flow. Also, the upper and lower terminal portions of the rib portions curve smoothly upwardly and downwardly respectively to intersect side edges of the tile adjacent the upper and lower corners 29 and 30 respectively, and curvatures of the terminal portions are generally equal to each other, so as to permit complementary overlapping of the rib portions as previously described, and as described in more detail with reference to FIGS. 4 and 5.

OPERATION

FIGS. 4 through 8

The roof which is to be tiled can be fitted with longitudinally extending battens, not shown, or plywood sheathing, depending on conventional building practice. If battens are used, eg. batten 90, FIG. 7, space between centres of adjacent battens corresponds to approximately one half of the length of the tile measured along the axis 12. For any roof structure the method of installing the tiles is essentially the same.

Tiles are first laid along the lower portion of the roof, preferably in horizontal lines extending from end to end of the roof. Adjacent horizontal rows of tiles are installed, one upon the other, working progressively up towards the ridge of the roof and along a perpendicular reference line extending from the eave to the ridge of the roof.

Figure 4:
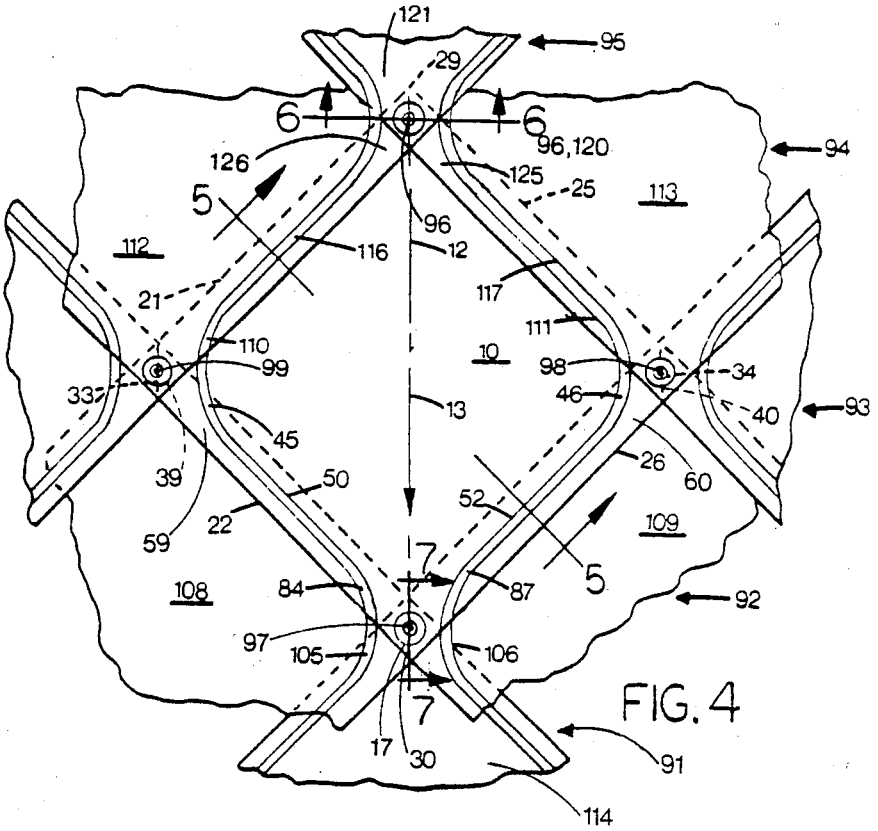
FIG. 4 is a simplified fragmented top plan of a plurality of tiles fitted together showing cooperation between adjacent tiles.

FIG. 4 shows portions of five horizontal rows of tiles, the rows designated 91 through 95 moving progressively up the roof. Mitred portions of adjacent tiles in the same row are closely adjacent each other, and four screws 96 through 99 are shown cooperating with respective raised bosses of tiles as will be described. Edges of tiles that are covered by side margins of other tiles are shown in broken outline, and it can be seen that all tile edges are well overlapped to reduce chances of water passing between tiles, either by wind force, water flow or capillarity.

For convenience of explanation, the tile 10 is shown as the central tile in the row 93 and it can be seen that the downwardly curved lower terminal portions 84 and 87 of the lower rib portions 50 and 52 merge smoothly with the raised ribs 105 and 106 respectively of two lower tiles 108 and 109 in the row 92. Similarly, lower terminal portions 110 and 111 of raised ribs of tiles 112 and 113 in the upper row 94 overlap and merge smoothly with the raised ribs 45 and 46 of the tile 10. Water flowing down the roof in direction of the arrow 13 is restricted only slightly by the continuous S-shaped curves of raised ribs and the raised bosses which never totally obstruct water flow. It is seen that the lower rib portions 50 and 52 of the tile 10 overlap completely upper rib portions, not shown in FIG. 4, of the tiles 108 and 109. Similarly, lower rib portions 116 and 117 of the tiles 112 and 113 overlap completely upper rib portions 49 and 51, not shown in FIG. 4, of tile 10.

The overlapping between the lower rib portions of the upper tile and upper rib portions of a lower tile are more clearly seen in FIG. 5 which shows cooperation between the tiles 112, 10 and 109. The rib portion 116 of the rib tile 112 is shown overlapping the rib portion 49 of tile 10, and the rib portion 52 of the tile 10 is shown overlapping upper rib portion 118 of the tile 109. The overlapping rib portions are shown to be exactly complementary, but this is not necessarily desirable or practical for tiles manufactured and installed to normal tolerances.

Figure 7:
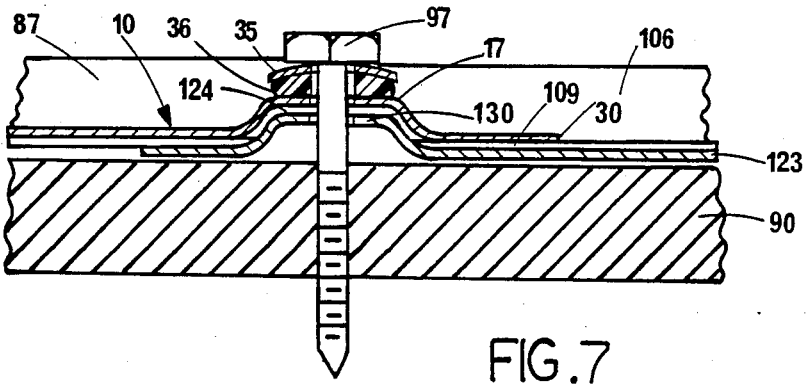
FIG. 7 is a simplified fragmented section on line 7—7 of FIG. 4, showing securing means cooperating with adjacent tiles, and a portion of an existing roof backing.
Figure 6:
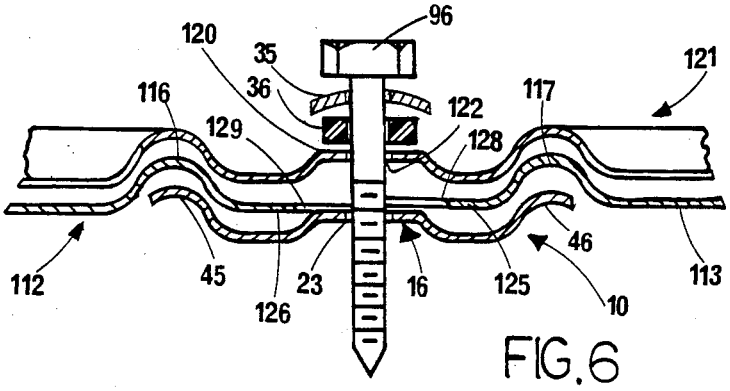
FIG. 6 is a simplified fragmented "exploded" section on line 6—6 of FIG. 4, showing tiles and fastening means separated before securing, and cooperation with adjacent tiles.
Figure 8:
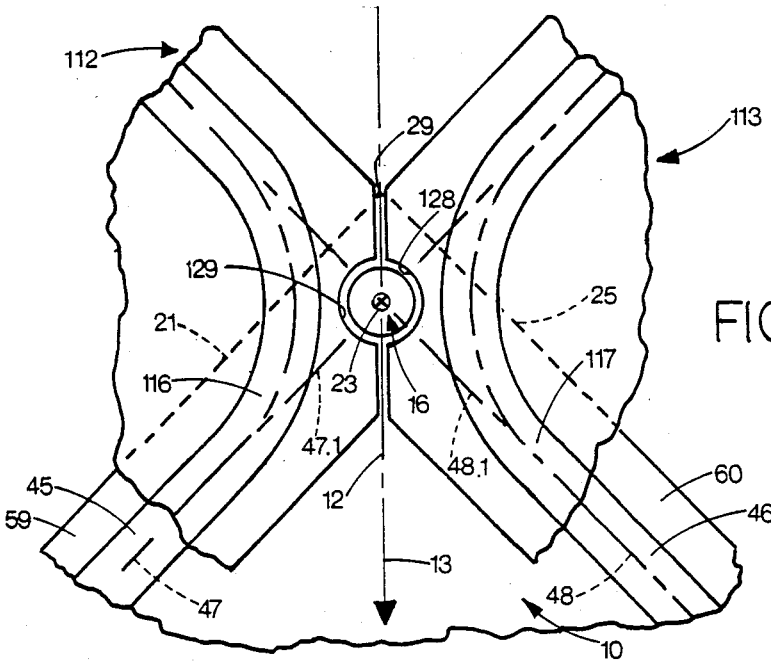
FIG. 8 is a simplified fragmented top plan showing cooperation between adjacent edge portions of three tiles, adjacent an upper boss, as could be seen in FIG. 6, with a screw and an upper tile removed.

As seen in FIG. 4, the upper and lower corners 29 and 30 are secured directly by the screws 96 and 97 passing through the respective clearance openings in the bosses 16 and 17. As also seen in FIG. 6, the boss 16 of the tile 10 is covered by a similar complementary lower boss 120 of a tile 121 in the row 95, which boss has a clearance opening 122 aligned with the opening 23 to receive the screw 96. Adjacent portions of the first and second flat side margins 125 and 126 of the tiles 113 and 112 respectively are sandwiched between the lower and upper corners respectively of the tiles 121 and 10. As best seen in FIG. 8, the side margins 125 and 126 have semi-circular edge recesses 128 and 129 in respective mitred portions, the edge recesses engaging the boss 16 from each side as shown. It can be seen in FIG. 6 that the marginal portions 125 and 126 are restrained against upward movement by the tile 121, and in FIG. 8 are restrained against lateral movement relative to the screw by the recesses 128 and 129 engaging the boss 16. Similarly the side margins 59 and 60 adjacent the edge recesses 39 and 40 of the tile 10 are restricted against vertical and transverse movement by portions of adjacent tiles and associated screws 99 and 98. Consequently the tile 10 is positively located at upper and lower corners by the screws 96 and 97 passing through the openings of the bosses, and is securely restricted by adjacent tiles at two positions at opposite ends of the lateral axis. Each tile is similarly secured at four locations, providing redundant restriction of each tile with no increase in the number of fasteners. In FIG. 7, because the tile 109 is sandwiched between the tile 10 and a lower tile 123 in row 91, a theoretical space 124 exists between the boss 17 of the tile 10 and a boss 130 of the tile 123, which space probably diminishes when the screw is tightened.

In summary it can be seen that the bosses 16 and 17 and respective openings 23 and 24 serve as upper and lower clearance means provided adjacent the upper and lower corners respectively to receive respective fasteners for securing the tile to backing means. Also the edge recesses 39 and 40 serve as first and second clearance means adjacent the first and second side edges of the tile which are generally complementary to the bosses and cooperate with bosses of adjacent tiles..

ALTERNATIVES

The tile 10 is shown as a square tile, with two oppositely mitred corners. Thus, angles between the four main edges of the tile are 90 degrees, and in general edges of the tile are equal in length. While this provides a conventional and pleasing tile appearance, variations of the overall shape of the tile are possible, provided the opposite side edges are disposed as mirror images about the axis 12, and the adjacent side edges are mirror images about the axis 27.

Also, in FIGS. 2 and 6, it can be seen that the cross-sections of the rib portions of each tile are generally complementary to each other, that is the cross section of each rib is a portion of an arc which merges smoothly with large radii into adjacent flat portions of the centre portion of the tile, and coplanar side margins of the tile. Clearly, upper portions of the lower tile which are overlapped by an upper tile could be of a different shape, and considerably smaller than under surfaces of the corresponding upper tile.

Figure 9:
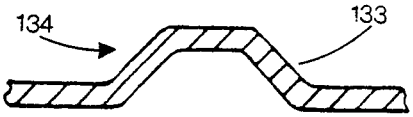
FIG. 9 is a simplified, fragmented section similar to FIG. 2 showing a portion of a second embodiment of the invention.

Thus the ribs could have a cross-section which varies along the length thereof provided lower rib portions could fit over and enclose upper rib portions so as to be complementary to each other. This would permit a greater tolerance to installing the tiles, and, in some cases, reduces chances of water being drawn by capillarity across the rib portions. Also, the ribs could be different cross-sections, i.e. triangular, or partially trapezoidal, as seen in FIG. 9. Many variations are possible, within the broad concept of the upper rib portions being complementary to the lower rib portions where the tiles overlap. While the preferred material of manufacture is corrosion resistant steel, aluminum alloy, copper, etc., or suitably reinforced plastic could be substituted.

Note that the ribs of the tile 10 are mirror images about the lateral axis 27, as well as about the central longitudinal axis 12. This could contrast with the alternatives above where only the rib axes of the ribs are mirror images about the lateral axis 27, in view of the difference between the cross-sections of the ribs and on opposite sides of the transverse lateral axis. The resulting loss of true two axis symmetry reduces some of the adaptability of the invention relating to using cut remnants of tile etc.

FIG. 9

FIG. 9 shows another an alternative cross-section of a raised rib 133 of an alternative tile 134 which shows a truncated triangular shaped section or partially trapezoidal section which would also permit use of a rib of constant cross-section.

I claim:

1. A tile adapted to cooperate with similar tiles to form a tiled surface over a backing means, the tile being a relatively thin sheet having:

(a) a periphery having first and second side edges intersecting at upper and lower corners, and being disposed symmetrically about a central longitudinal axis extending between the corners and adapted so that, when the tile is installed, the central axis coincides essentially with a line defining free water flow down the tile, the tile having a lateral axis disposed normally to the central axis to divide the tile into upper and lower tile portions, (b) first and second raised ribs having respective rib axes extending symmetrically as mirror images of each other on each side of the central longitudinal axis, each rib having upper and lower rib portions on opposite sides of the lateral axis which are interconnected so as to extend continuously between the upper and lower tile portions to increase stiffness of the tile, the rib axes being mirror images of each other about the lateral axis, and the upper rib portions being generally complementary to the lower rib portions so that the lower rib portions of an upper tile can fit over the upper rib portions of a lower tile, the ribs intersecting the respective side edges at positions spaced laterally from, but generally adjacent to, the upper and lower corners to provide first and second intermediate edge portions extending between the intersections of the first and second ribs with the first and second side edges respectively, (c) a generally flat first side margin of the tile extending between the first intermediate edge portion and the first rib; and a similar generally flat second side margin of the tile extending between the second intermediate edge portion and the second rib, so that the tile has essentially flat side margins extending along most of the first and second side edges to provide an adequate overlap with adjacent tiles, (d) upper and lower clearance means provided adjacent the upper and lower corners respectively, the clearance means having respective raised portions with openings passing therethrough to receive respective fasteners for securing the tile to the backing means, and (e) first and second clearance means adjacent the first and second side edges respectively to cooperate with clearance means of adjacent tiles to locate side edges of the tile.

2. A tile as claimed in claim 1 in which:

(a) the upper rib portion of each rib has a convex upper rib surface, (b) the lower rib portion of each rib has a concave lower rib surface which is generally complementary to the convex upper rib surface, so as to permit the lower rib portion of the upper tile to fit closely over the upper rib portion of the lower tile.

3. A tile as claimed in claim 1 in which:

(a) the first and second clearance means are provided at approximate mid points of the first and second side edges so as to be essentially equally spaced from the upper and lower corners of the tile.

4. A tile claimed in claim 1 in which:

(a) the upper and lower rib portion have essentially equal and constant cross-sections along complete lengths thereof.

5. A tile as claimed in claim 1 in which:

(a) the tile has a generally flat central portion which is generally coplanar with the first and second side margins of the tile.

6. A tile as claimed in claim 1 in which:

(a) each side edge has generally straight upper side edge and lower side edge portions which are inclined at equal angles to the lateral axis of the tile to define a generally diamond shaped tile.

7. A tile as claimed in claim 1 in which:
(a) the raised portions of the upper and lower clearance means include upper and lower raised bosses with respective openings to receive respective fasteners,
(b) the first and second clearance means are adapted to provide clearance for, and to engage, bosses of adjacent tiles.

8. A tile as claimed in claim 7 in which:
(a) the bosses are circular in planform and the openings are disposed centrally thereof,
(b) the first and second clearance means include edge recesses in the first and second side edges respectively, the edge recesses being generally semi-circular and generally complementary to portions of the bosses.

9. A tile as claimed in claim 1 in which:
(a) each side edge has generally straight upper side edge and lower side edge portions which are inclined at equal angles to the lateral axis to define a generally diamond shaped tile,
(b) each upper rib portion has a generally shallow S-shape with a generally straight mid portion disposed between upwardly and downwardly curved upper and lower terminal portions, the mid portion being generally parallel to an adjacent upper side edge portion.
(c) each lower rib portion has a generally shallow S-shape with a generally straight mid portion disposed between upwardly and downwardly curved upper and lower terminal portions, the mid portion being generally parallel to an adjacent lower side edge portion.

10. A tile as claimed in claim 8 in which:
(a) the upper clearance means is provided between the upper terminal portions of the upper rib portions.
(b) the lower clearance means is provided between the lower terminal portions of the lower rib portions.

11. A tile as claimed in claim 1 in which:
(a) the upper and lower rib portions have upper and lower terminal portions respectively which are spaced apart to provide clearance therebetween to permit water to pass easily down the tile,
(b) the upper clearance means and the lower clearance means are provided between the upper terminal portions and lower terminal portions respectively of the ribs.

12. A tile as claimed in claim 6 in which:
(a) a first mitred edge portion interconnects the upper and lower edge portions of the first side edge,
(b) a second mitred edge portion interconnects the upper and lower edge portions of the second side edge, the first and second mitred edge portions being disposed symmetrically relative to the central and lateral axes.

13. A tile as claimed in claim 12 in which:
(a) the first and second clearance means are provided adjacent opposite ends of the lateral axis.

14. A tile as claimed in claim 12 in which:
(a) the first and second clearance means include edge recesses in the first and second mitred edge portions respectively adjacent opposite ends of the lateral axis.

15. A tile as claimed in claim 14 in which:
(a) the upper and lower clearance means include a raised boss of circular planform with an opening to receive the respective fastener,
(b) the first and second clearance means include semi-circular edge recesses generally complementary to portions of the bosses and disposed symmetrically of the transverse axis.

16. A tile as claimed in claim 1 in which:
(a) the upper and lower clearance means are spaced equally from the first and second clearance means.

17. A tile as claimed in claim 1 in which:
(a) the upper and lower clearance means have respective openings located on the central axis at equal perpendicular distances from the lateral axis,
(b) the first and second clearance means are located in the lateral axis at equal distances from central axis, which distances are equal to the said perpendicular distances relating to the upper and lower clearance means.

18. A tile as claimed in claim 9 in which:
(a) the rib axes of the straight mid portions of the upper rib portions have upwardly extending axial projections which intersect the central axis at the upper clearance means,
(b) the rib axes of the straight mid portions of the lower rib portions have downwardly extending axial projections which intersect at the lower clearance means.

19. A tile as claimed in claim 18 in which:
(a) downwardly extending axial projections of rib axes of the upper rib portions intersect upwardly extending axial projections of the rib axes of the lower rib portions at the first and second clearance means.

20. A tile as claimed in claim 19 in which:
(a) the upper clearance means has a circular boss having an opening provided at the intersection of the upwardly extending axial projections of the rib axes of the upper rib portions,
(b) the lower clearance means has a circular boss having an opening provided at the intersection of the downwardly extending axial projections of the rib axes of the upper rib portions,
(c) the first and second clearance means are edge recesses in the first and second side edges respectively, the edge recesses being generally semi-circular and generally complementary to portions of the circular bosses,
(d) downwardly extending axial projections of the rib axes of upper rib portions intersect upwardly extending axial projection of the rib axes of the lower rib portions at theoretical centres of the generally semi-circular recesses.

* * * * *